US012000244B2

(12) United States Patent
Alatigue et al.

(10) Patent No.: US 12,000,244 B2
(45) Date of Patent: Jun. 4, 2024

(54) DETERMINING EFFICIENCIES OF WELLBORE PRESSURE CONTROL VALVES

(71) Applicant: Saudi Arabian Oil Company, Dhahran (SA)

(72) Inventors: Mohammed Alatigue, Dammam (SA); Anton Tarihoran, Udhailiyah (SA); Nahr M. Abulhamayel, Udhailiyah (SA); Abdulrahman Aljughayman, Udhailiyah (SA); Abdulaziz Al Lajam, Udhailyah (SA)

(73) Assignee: Saudi Arabian Oil Company, Dhahran (SA)

( * ) Notice: Subject to any disclaimer, the term of this patent is extended or adjusted under 35 U.S.C. 154(b) by 68 days.

(21) Appl. No.: 17/589,404

(22) Filed: Jan. 31, 2022

(65) Prior Publication Data

US 2023/0243239 A1 Aug. 3, 2023

(51) Int. Cl.

| | |
|---|---|
| ***E21B 34/16*** | (2006.01) |
| ***E21B 34/08*** | (2006.01) |
| ***E21B 43/12*** | (2006.01) |
| ***E21B 47/06*** | (2012.01) |

(52) U.S. Cl.

CPC ..... *E21B 34/16* (2013.01); *E21B 34/08* (2013.01); *E21B 43/12* (2013.01); *E21B 47/06* (2013.01)

(58) Field of Classification Search

CPC ..... E21B 34/16; E21B 43/12; E21B 47/06

See application file for complete search history.

(56) References Cited

U.S. PATENT DOCUMENTS

| | | | | |
|---|---|---|---|---|
| 6,591,201 | B1 * | 7/2003 | Hyde | G01F 25/10 700/282 |
| 6,807,501 | B1 * | 10/2004 | Hyde | E21B 47/06 700/28 |
| 9,031,674 | B2 * | 5/2015 | Rashid | E21B 43/00 700/32 |

* cited by examiner

*Primary Examiner* — Catherine Loikith

(74) *Attorney, Agent, or Firm* — Fish & Richardson P.C.

(57) ABSTRACT

To determine efficiencies of wellbore pressure control valves, results of manufacturer tests performed by a manufacturer of a pressure control valve (PCV) are identified. The PCV is configured to control flowrate of a fluid through a pipeline. The manufacturer tests correlate quantities of the fluid that the PCV allows to flow through the pipeline at respective open positions of the PCV. After installing the PCV in a flowline downstream of a production tree disposed within a hydrocarbon gas production wellbore to control hydrocarbon gas flowrate through the production wellbore, operational tests are performed on the PCV to measure quantities of the hydrocarbon gas that the PCV allows to flow through the flowline at the respective open positions of the PCV. The results of the manufacturer tests are compared with results of the operational tests. Based on a result of the comparing, an operational condition of the PCV is determined.

17 Claims, 3 Drawing Sheets

DETERMINING EFFICIENCIES OF WELLBORE PRESSURE CONTROL VALVES

TECHNICAL FIELD

This disclosure relates to wellbores and specifically to controlling hydrocarbon fluid flow through wellbores.

BACKGROUND

Hydrocarbons entrapped in subterranean zones (for example, a formation, a portion of a formation or multiple formations) can be raised (i.e., produced) to the surface through wellbores formed from the surface through the subterranean zones. The hydrocarbons can include fluids including petroleum, natural gas, or combinations of them. In some instances, water can also be entrapped in the subterranean zones and can flow to the surface with the produce hydrocarbons. The hydrocarbon tubular flow through the wellbore and at the surface of the wellbore can be controlled by installing tubulars within the wellbore and at the surface, and by installing pressure control valves (PCVs) within the tubulars. Due to the operational conditions of the wellbore and due to the corrosive nature of the hydrocarbons, PCVs can fail over time.

SUMMARY

This disclosure describes technologies relating to determining efficiencies of wellbore PCVs.

Certain aspects of the subject matter described here can be implemented as a method. Results of manufacturer tests performed by a manufacturer of a pressure control valve (PCV) are identified. The PCV is configured to control flowrate of a fluid through a pipeline. The manufacturer tests correlate quantities of the fluid that the PCV allows to flow through the pipeline at respective open positions of the PCV. After installing the PCV in a flowline downstream of a production tree disposed within a hydrocarbon gas production wellbore to control hydrocarbon gas flowrate through the production wellbore, operational tests are performed on the PCV to measure quantities of the hydrocarbon gas that the PCV allows to flow through the flowline at the respective open positions of the PCV. The results of the manufacturer tests are compared with results of the operational tests. Based on a result of the comparing, an operational condition of the PCV is determined.

An aspect combinable with any other aspect includes the following features. To perform the operational tests on the PCV, (a) the PCV is set to an open position, (b) a flowing wellhead pressure (FWHP) of the production wellbore is measured at the open position of the PCV, (c) a hydrocarbon gas flow rate is measured through the flowline at the open position of the PCV, (d) a condensate rate is measured through the flowline at the open position of the PCV, (e) a condensate to gas ratio (CGR) is determined by dividing the condensate rate by the hydrocarbon gas flow rate, and (f) a choke size at the open position of the PCV is determined based on the FWHP, the hydrocarbon gas flowrate and the CGR at the open position of the PCV.

An aspect combinable with any other aspect includes the following features. Steps (a), (b), (c), (d) and (e) are repeated at each of the open positions. A plot of multiple choke sizes versus the respective open positions of the PCV is generated.

An aspect combinable with any other aspect includes the following features. To determine the choke size at the open position of the PCV based on the FWHP, the hydrocarbon gas flowrate and the CGR at the open position of the PCV, the following equation is solved:

$$\left(\frac{d}{64}\right) = \sqrt[1.85146181546]{\frac{qg \cdot 59.8929355006557 \cdot CGR^{0.1031801407188}}{FWHP}}.$$

In the above equation, d is the choke size, and qg is the hydrocarbon flowrate.

An aspect combinable with any other aspect includes the following features. Results of the manufacturer tests include a manufacturer plot of multiple choke sizes versus the respective open positions of the PCV. To compare the results of the manufacturer tests with results of the operational tests, a difference between an area under the manufacturer plot and an area under the plot is determined. The difference is compared with a threshold area.

An aspect combinable with any other aspect includes the following features. To determine an operational condition of the PCV based on a result of the comparing, it is determined that the difference exceeds the threshold area. In response, it is determined that the operational condition of the PCV is faulty.

An aspect combinable with any other aspect includes the following features. In response to determining that the operational condition of the PCV is faulty, an alert is transmitted to rectify the PCV.

An aspect combinable with any other aspect includes the following features. In response to determining that the operational condition of the PCV is faulty, the hydrocarbon gas production through the wellbore is ceased. The PCV is replaced with a new PCV. The hydrocarbon gas production through the production wellbore is re-started.

Certain aspects of the subject matter described here can be implemented as a computer-implemented method. For a PCV that can control flowrate of a fluid through a pipeline, a manufacturer plot of multiple choke sizes versus respective open positions of the PCV is received. The manufacturer plot correlates quantities of the fluid that the PCV allows to flow through the pipeline at the respective open positions of the PCV. After installing the PCV in a flowline downstream of a production tree disposed within a hydrocarbon gas production wellbore to control hydrocarbon gas flowrate through the production tree, a plot of multiple choke sizes versus the respective open positions of the PCV is received. The plot is generated responsive to performing operational tests to measure quantities of the hydrocarbon gas that the PCV allows to flow through the flowline at the respective open positions of the PCV. The manufacturer plot is compared with the plot. Based on a result of the comparing, it is determined that an operational condition of the PCV is faulty. In response, an alert is transmitted indicating the faulty operational condition of the PCV.

An aspect combinable with any other aspect includes the following features. To perform the operational tests on the PCV, (a) the PCV is set to an open position, (b) a flowing wellhead pressure (FWHP) of the production wellbore is measured at the open position of the PCV, (c) a hydrocarbon gas flow rate is measured through the flowline at the open position of the PCV, (d) a condensate rate is measured through the flowline at the open position of the PCV, (e) a condensate to gas ratio (CGR) is determined by dividing the condensate rate by the hydrocarbon gas flow rate, and (f) a choke size at the open position of the PCV is determined based on the FWHP, the hydrocarbon gas flowrate and the CGR at the open position of the PCV.

An aspect combinable with any other aspect includes the following features. Steps (a), (b), (c), (d) and (e) are repeated at each of the open positions. A plot of multiple choke sizes versus the respective open positions of the PCV is generated.

An aspect combinable with any other aspect includes the following features. To determine the choke size at the open position of the PCV based on the FWHP, the hydrocarbon gas flowrate and the CGR at the open position of the PCV, the following equation is solved:

$$\left(\frac{d}{64}\right) = \sqrt[1.85146181546]{\frac{qg \cdot 59.8929355006557 \cdot CGR^{0.1031801407188}}{FWHP}}.$$

In the above equation, d is the choke size, and qg is the hydrocarbon flowrate.

An aspect combinable with any other aspect includes the following features. Results of the manufacturer tests include a manufacturer plot of multiple choke sizes versus the respective open positions of the PCV. To compare the results of the manufacturer tests with results of the operational tests, a difference between an area under the manufacturer plot and an area under the plot is determined. The difference is compared with a threshold area.

An aspect combinable with any other aspect includes the following features. To determine that an operational condition of the PCV is faulty based on a result of the comparing, it is determined that the difference exceeds the threshold area.

Certain aspects of the subject matter described here can be implemented as a non-transitory computer-readable medium storing instructions executable by one or more computer systems to perform the methods described here. Certain aspects of the subject matter described here can be implemented as a computer system including one or more computer systems and a non-transitory computer-readable medium storing instructions executable by the non-transitory computer-readable medium to perform the methods described here.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1:
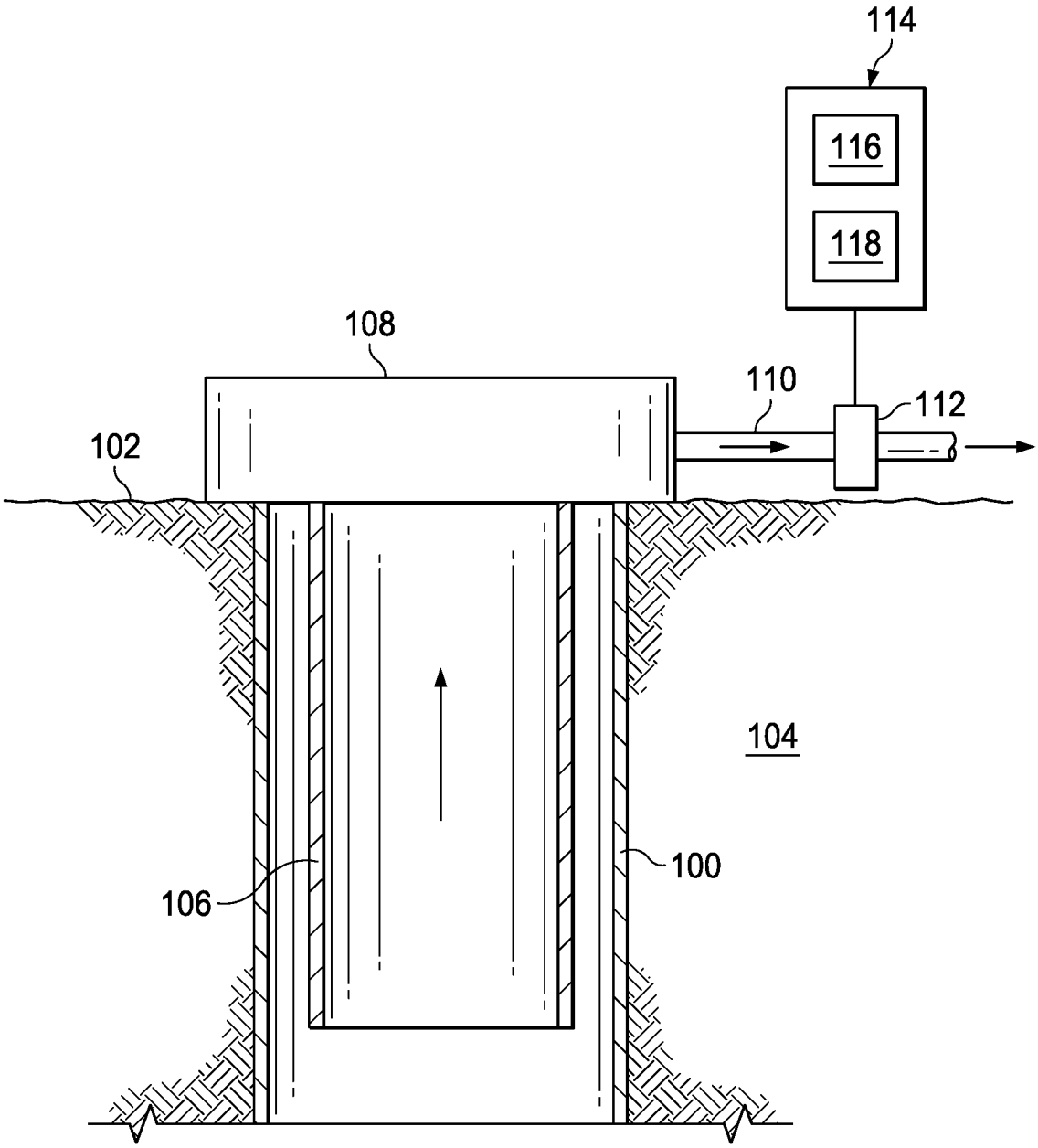
FIG. 1 is a schematic diagram of an example of a gas wellbore.

A PCV is a flow control tool installed in a flowline downstream of a production tree disposed in a wellbore. The PCV is operated to control pressure of the hydrocarbon fluid that flows through the flowline during the production cycle. For any hydrocarbon fluid, such as natural gas, floated through the flowline is a function of pressure differential. Therefore, the expected gas flowrate can be achieved by adjusting the PCV. In general, the PCV includes an orifice that has a diameter that is smaller than a diameter of the flowline in which the PCV is installed. The pressure differential in the flowline can be varied by varying an amount by which the orifice is open. Thus, different positions of the PCV (between a fully closed position and a fully open position) correspond to respective different amounts by which the orifice is open (between fully closed and fully open, respectively), which, in turn, corresponds to different pressure differentials across the flowline (between maximum pressure differential and no pressure differential, respectively).

A lifetime of the PCV depends on the material with which the PCV is made and properties of the produce hydrocarbons that flow past the PCV. Usually, a physical check of the PCV is performed when the target hydrocarbon flowrate through the flowline cannot be achieved. In such instances, the wellbore is shut-in and the PCV is repaired or replaced resulting in wellbore non-productive time (NPT).

This disclosure describes techniques to determine operational capabilities of a PCV that is installed in a flowline through which multiphase hydrocarbon fluid (i.e., hydrocarbon fluid that includes natural gas and liquid, such as water) flows. The flowline can be connected to a gas wellbore formed in a gas field with the high liquid to gas ratio. In some instances, such a gas field is located in a remote area, and the gas flowrate is estimated using developed choke's equation because there is no multi-phase meter to measure the hydrocarbon rate within an acceptable error. An input to the choke's equation is an operating pressure which is controlled by the PCV. Consequently, a PCV opening, which corresponds to a quantity of fluid that the PCV will allow to flow, is used as an input to choke's equation. The choke's equation is then solved to determine the gas flowrate through the flowline.

PCV manufacturers typically perform manufacturer tests that correlate a choke size (i.e., a quantity of a fluid that the PCV allows to flow through a pipeline in which the PCV is installed) to a respective open position of the PCV. Such manufacturer tests allows a user to select the PCV most suited to their requirements. In certain implementations of this disclosure, similar operational tests are performed on a PCV that is installed in a flowline downstream of a production tree disposed within a hydrocarbon gas production wellbore to control hydrocarbon gas flowrate through the production wellbore. By comparing the results of the manufacturer test with the results of the operational tests, and operational condition of the PCV can be determined.

Implementations of the subject matter described here can provide one or more of the following advantages. The techniques represent novel integration technology to detect reservoir mobility and flowrate uncertainty. The techniques can be implemented to evaluate PCV conditions. The techniques can reduce NPT by mathematically estimating when a PCV will need to be repaired or replaced in the future, rather than needing to shut-in the well when the PCV has failed. The techniques would also provide a better plan in maintaining the PCV inventory as well as maintaining hydrocarbon deliverables.

FIG. 1 is a schematic diagram of an example of a gas wellbore 100 is formed from a surface 102 through a subterranean zone 104. The wellbore 100 can be cased and have an arrangement of tubulars or a production tree 106 disposed within the wellbore 100, or can be an open wellbore. A wellhead 108 installed at the surface 102 can connect a flowline 110 to the wellbore 100 such that hydrocarbon fluids produced through the wellbore 100 flowed through the flowline 110. A PCV 112 is installed in the flowline 110 to regulate flow of the hydrocarbon fluids through the flowline 110. The hydrocarbon fluids can include multiphase fluids including natural gas and water. An operator can regulate a hydrocarbon fluid flowrate through the flowline 110 by positioning the PCV 112 at one of multiple positions ranging between fully closed and fully open.

In some implementations, a computer system 114 is operatively connected to the PCV 112. The computer system 114 includes one or more processors 116 (or data processing apparatuses) and a computer-readable medium 118 (for example, a non-transitory computer-readable medium) that can store computer instructions executable by the one or more processors 116 to perform operations described here.

In some implementations, the computer system 114 can identify results of manufacturer tests performed by a manufacturer of the PCV 112. The manufacturer tests correlate quantities of the hydrocarbon fluid that the PCV 112 allows to flow through a pipeline (used by the manufacturer and tested at the manufacturer's site) at respective open positions of the PCV 112. As described later, an output of the manufacturer tests is a manufacturer plot of multiple choke sizes versus respective open positions of the PCV 112. After the PCV 112 has been installed in the flowline 110, an operator performs operational tests on the PCV 112 to measure quantities of the hydrocarbon fluid that the PCV 112 allows to flow through the flowline 110 at the respective open positions of the PCV 112. As described later, an output of the operational tests is a plot of the multiple choke sizes versus respective open positions of the PCV 112, while the PCV 112 is being used to control flow through the flowline 110. The computer system 114 compares the results of the manufacturer tests with the results of the operational tests. Based on a result of the combating, the computer system 114 determines an operational condition of the PCV 112. For example, if a difference between the manufacturer plot and the plot outputted by the operational tests is within a threshold difference, then the computer system 114 determines that the PCV 112 is operating in a satisfactory manner. Conversely, if the difference does not satisfy the threshold difference, then the computer system 114 determines that the PCV 112 is not operating in a satisfactory manner. In response, the computer system 114 can alert the operator, and the operator can implement remedial action such as replacement or repair of the PCV 112.

Figure 2:
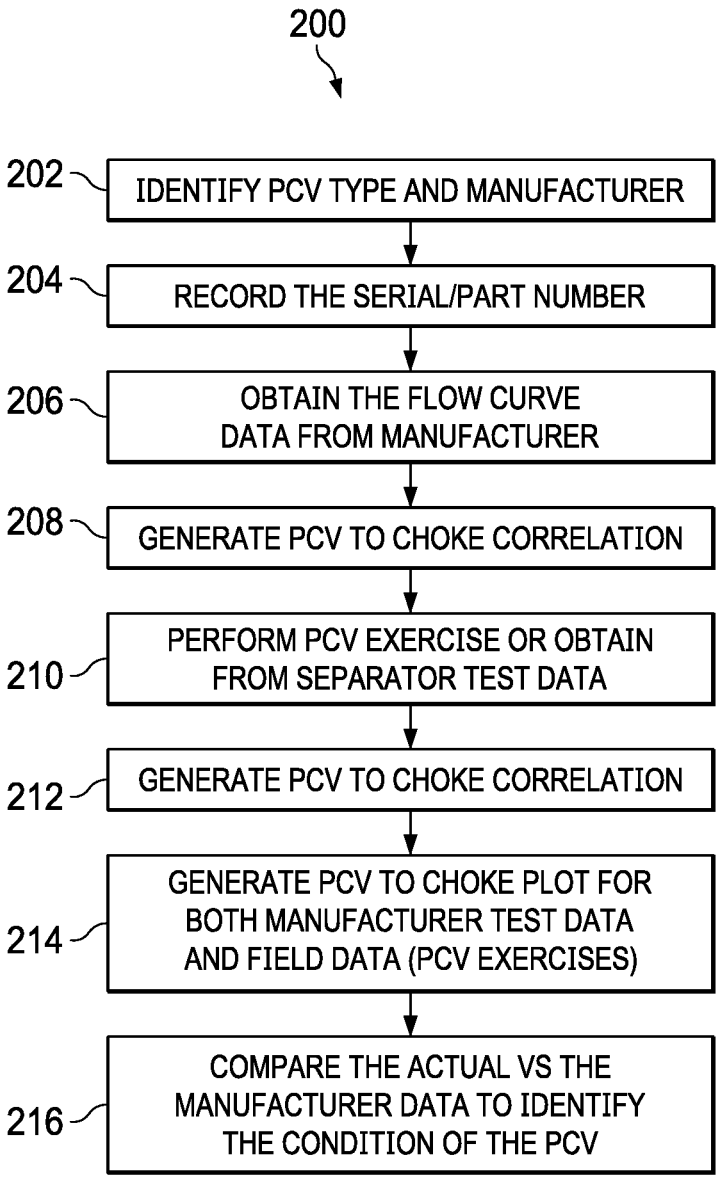
FIG. 2 a is a flow diagram of an example of determining an efficiency of a PCV implemented in the gas wellbore of FIG. 1.

FIG. 2 a is a flow diagram 200 of an example of determining an efficiency of a PCV (for example, the PCV 112) implemented in the gas wellbore of FIG. 1. Certain steps of the flow diagram 200 are implemented by an operator of the wellbore 100 or of the computer system 114, and certain steps of the flow diagram 200 are implemented by the computer system 114. At step 202, the operator identifies a type and manufacturer of the PCV 112. At step 204, the operator identifies operational details of the PCV 112. For example, the operator identifies a serial number of the PCV 112. Manufacturers of PCVs usually perform manufacturer tests for several valves with different serial numbers. By identifying the serial number of the PCV 112, the operator can identify the manufacturer test performed specifically for the PCV 112. An example of operational details of a PCV is shown in the table below.

| Well No. | PCV Manufacturer | Serial Number I Part Number | Trim Characteristic |
|---|---|---|---|
| TINT-1234 | Limitorque I Cameron | L1002195/ 112907583-12 | Equal Percentage CV 64 |

At step 206, the operator identifies flow curve data associated with the PCV 112. The flow curve data is the manufacturer test that is provided as input to the computer system 114. The flow curve is designed for each manufacturer and is based on the manufacturer test performed by the manufacturer. The flow curve provides correlation between choke sizes (in increments of $1/64^{th}$ inch) and open positions of the PCV 112. An example of flow curve data of a PCV is shown in the table below.

| | | | | | | | | | | | | |
|---|---|---|---|---|---|---|---|---|---|---|---|---|
| Cv | 0 | 0 | 0.19 | 4.3 | 6.19 | 7.21 | 9.94 | 17.44 | 28.01 | 43.32 | 58.48 | 64 |
| % Travel | 0 | 9 | 18 | 27 | 36 | 45 | 55 | 64 | 73 | 82 | 91 | 100 |
| % Open | 0 | 0 | 2 | 4 | 6 | 9 | 13 | 26 | 46 | 68 | 88 | 100 |
| 64ths | 0 | 0 | 17 | 24 | 30 | 36 | 44 | 62 | 83 | 100 | 114 | 122 |

The table shows the Cv value during flow test. Let us take the column 4 as an example. When the % Travel of PCV is 18%, the PCV opening is equal to 2% which is correlated to 17/64 choke opening. At this point, the Cv is 0.19. The logic applies to other columns until 100% Travel and Open.

At step 208, the computer system 114 generates a PCV to choke correlation. In some implementations, the operator inputs the flow curve data identified at step 206 to the computer system 114. The computer system 114 generates the manufacturer plot using the table. In some implementations, the flow curve data is provided by the manufacturer in the format of the manufacturer plot. The manufacturer plot plots percentage openings of the PCV 112 on the X-axis and corresponding choke sizes (measured in $1/64^{th}$ inch) on the Y-axis.

At step 210, the operator performs a PCV exercise or obtains separator test data. The output of the PCV exercise or the separator test data is the operational plot that is compared with the manufacturer plot obtained from the manufacturer tests. PCV Exercises is exercising PCV by adjusting its opening and recording the flowrate in the three-phase separator. During PCV exercise, the choke that normally rig up to control the flow is set to fully open. Separator test is the same as well testing or deliverability testing where the well performance is tested at different flowrate. During separator test, the PCV opening is set at fully open and the choke is adjusted to achieve the target flowrate. Both PCV exercise and deliverability test are using three-phase separator to measure the flowrate. During deliverability test with three-phase separator, prior to commencing the well test, the operator performs the PCV exercise to confirm PCV reliability and efficiency. The operator performs the exercise by adjusting PCV to several openings depending on the physical history during operating the well. The PCV normally exercised is up to 50% open. In some instances, the data to compare can be based on the historical opening that has been adjusted during operating the well. In one example, during the PCV exercise, the PCV 112 is fully open corresponding to a choke size of 2". An example of flow data from a separator captured by the operator is shown in the following table.

| | PCV | | Three-Phase Separator | | |
|---|---|---|---|---|---|
| Date | Opening (%) | FWHP (psi) | Gas Rate (MMscfd) | Condensate Rate (BCPD) | Water Rate (BWPD) |
| 2/19/2015 2:30 | 56.5 | 2,716 | 21.6 | 7,415 | 0 |
| 2/19/2015 4:00 | 46.6 | 3,112 | 13.4 | 5,849 | 0 |
| 2/19/2015 5:30 | 30 | 3,279 | 10.6 | 3,955 | 0 |
| 2/19/2015 6:30 | 20 | 3,312 | 8.1 | 3,007 | |
| 2/19/2015 8:00 | 10 | 3,363 | 5.5 | 2,128 | 0 |

At step 212, the computer system 114 generates a PCV to choke correlation from the flow data obtained in step 210. In some implementations, the operator inputs the flow data obtained at step 206 to the computer system 114. At step 214, the computer system 114 generates the operational plot using the table. The operational plot plots percentage openings of the PCV 112 on the X-axis and corresponding choke sizes (measured in $1164^{th}$ inch) on the Y-axis. While the manufacturer plot shows what choke sizes are appropriate for the PCV 112 at the different percentage open positions, the operational plot what choke sizes are actually being observed for the PCV 112 at the different percentage open positions when the PCV 112 is installed in the flowline 110 and operated to control gas flowrate from the wellbore 100.

At step 216, the computer system 116 compares the operational plot (i.e., the actual performance of the PCV 112) with the manufacturer plot (i.e., the expected performance of the PCV 112). If the operational plot and the manufacturer plots match or if the difference between the two plots falls within an acceptable threshold difference, then it can be concluded that the PCV 112 is operating as expected. Otherwise, it can be concluded that the PCV 112 needs replacement or repair. The operator can implement necessary remedial actions proactively rather than reactively when a wellbore operation failure necessitates shut-in.

Figure 3:
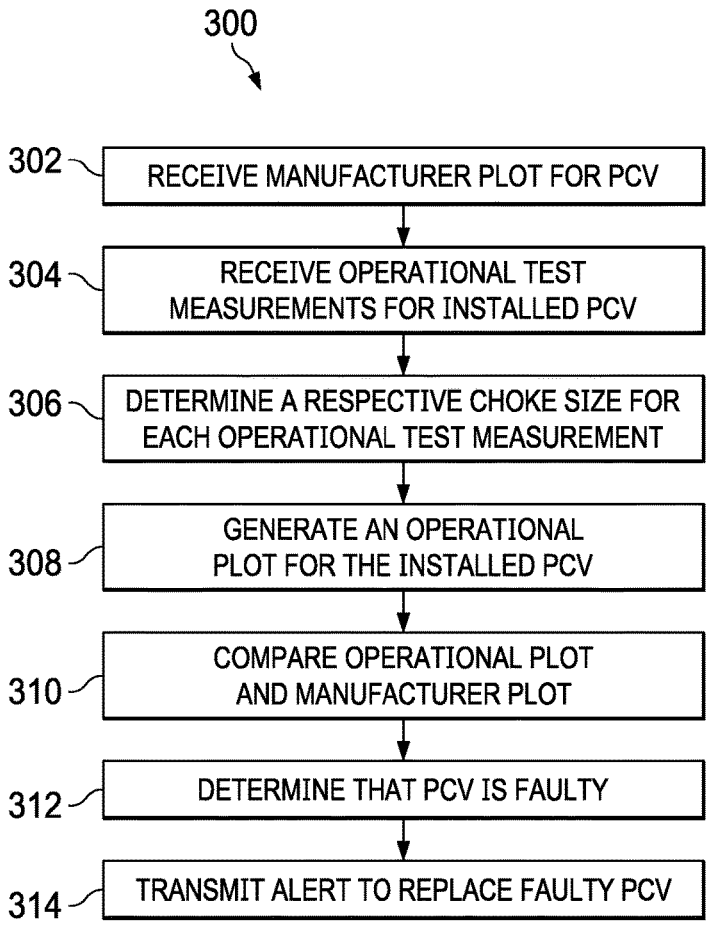
FIG. 3 is a flowchart of an example of a method of determining an efficiency of a PCV implemented in the gas wellbore of FIG. 1.

FIG. 3 is a flowchart of an example of a method 300 of determining an efficiency of a PCV (for example, the PCV 112) implemented in the gas wellbore of FIG. 1. In some implementations, the computer system 114 can implement the method 300.

At step 302, the computer system 114 receives a manufacturer plot of multiple choke sizes versus respective open positions of the PCV 112. As described above, the PCV 112 is implemented to control flowrate of a fluid through a pipeline. At step 304, the computer system 114 receives a plot of multiple choke sizes versus the respective open positions of the PCV after the PCV 112 has been installed in the flowline 110 downstream of the production tree 106 disposed within the wellbore 100 to control hydrocarbon gas flowrate through the wellbore 100. The plot is generated responsive to performing operational tests to measure quantities of the hydrocarbon gas that the PCV 112 allows to flow through the flowline 110 at the respective open positions of the PCV 112.

In some implementations, the operator of the wellbore 100 or the PCV 112 performs the following steps to implement the operational tests: (a) set the PCV 112 to an open position, (b) measure a flowing wellhead pressure (FWHP) of the wellbore 100 at the open position of the PCV, (c) measure a gas flowrate through the flowline 110 at the open position of the PCV 112, (d) measure a hydrocarbon gas flow rate through the flowline 110 at the open position of the PCV 112, and (d) measure a hydrocarbon gas flowrate through the flowline 110 at the open position of the PCV 112. The operator repeats steps (a)-(d) for multiple, different open positions of the PCV 112.

In response to the operator performing steps (a)-(d), the computer system 114 performs the following steps: (e) receive the open position of the PCV 112, the FWHP, the hydrocarbon gas flowrate and the condensate rate, (f) determine a condensate to gas ratio (CGR) by dividing the condensate rate by the hydrocarbon gas flowrate, and (g) determine a choke size at the open position of the PCV 112 based on the FWHP, the hydrocarbon gas flowrate and the CGR at the open position of the PCV 112.

At step 306, to determine the choke size at the open position of the PCV 112 based on the FWHP, the hydrocarbon gas flowrate and the CGR at the open position of the PCV 112, the computer system 114 solves the following equation:

$$\left(\frac{d}{64}\right) = \sqrt[1.8514618154 6]{\frac{qg \cdot 59.8929355006557 \cdot CGR^{0.1031801407188}}{FWHP}}$$

In the equation above, d is the choke size, and qg is the hydrocarbon gas flowrate.

The develop the operational plot, the operator repeats steps (a)-(d), and inputs the measurements to the computer system 114. In response, at step 308, the computer system 114 repeats steps (e)-(g) and generates the plot of multiple choke sizes versus the respective open positions of the PCV 112.

Figure 4:
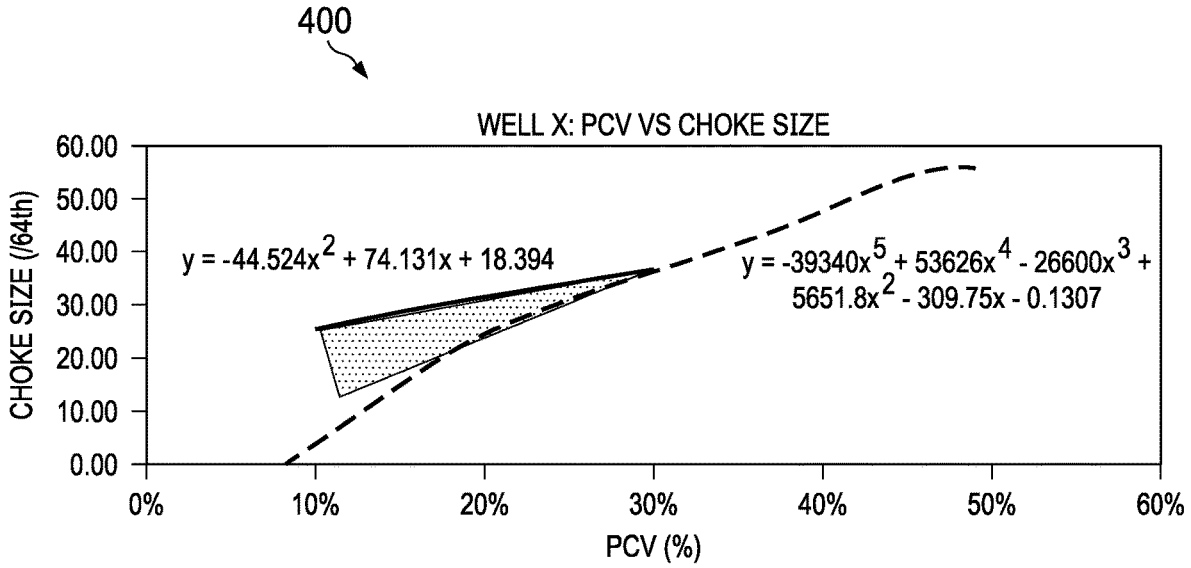
FIG. 4 is an example of a comparison of a manufacturer plot and an operational plot. Like reference numbers and designations in the various drawings indicate like elements.

At step 310, the computer system 114 compares the manufacturer plot with the operational plot. FIG. 4 is an example plot 400 of a comparison of a manufacturer plot and an operational plot. In the example, the manufacturer plot is shown as a solid line and the operational plot is shown as a dashed line. To compare the two plots, in some implementations, the computer system 114 determines a difference between an area under the manufacturer plot and an area under the operational plot, and compares the difference with a threshold area. For example, the computer system 114 can implement curve-fitting algorithms to determine a polynomial equation for each of the manufacturer plot and the operational plot. The computer system 114 can determine a difference between the two plots by determining a difference between their respective polynomial equations. Alternatively, the computer system 114 can determine, for each open position of the PCV 112, a difference between a determined choke size for the manufacturer plot and a determined choke size for the operational plot.

At step 312, based on a result of comparing the manufacturer plot and the operational plot, the computer system 114 determines that an operational condition of the PCV is faulty. For example, the computer system 114 does so upon determining that the difference between the area under the curve of the manufacturer plot and that of the operational plot is greater than a threshold area. Alternatively, the computer system 114 does so upon determining that the slot of the manufacturer plot and that of the operational plot for any combination of two different open positions of the PCV 112 exceed a threshold slope.

At step 314, the computer system 114 transmits an alert in response to determining that the operational condition of the PCV is faulty. For example, the computer system 114 can be operatively coupled to a computer monitor or to another computer system (for example, over wired or wireless connections). The computer system 114 can transmit a signal to be displayed on the computer monitor or to be processed by the other computer system. In this manner, the computer system 114 alerts the operator of the faulty operational condition of the PCV 112.

In response, the operator can perform real world remedial steps. For example, the operator can cease the hydrocarbon production through the wellbore 100, repair the PCV 112 or replace the PCV 112 with a new PCT, and then re-start the hydrocarbon production through the wellbore 100. In another example, the operator can visit the well site to check the internal part of the PCV 112.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a sub combination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims.

The invention claimed is:

1. A method comprising:

identifying results of manufacturer tests performed by a manufacturer of a pressure control valve (PCV) configured to control flowrate of a fluid through a pipeline, wherein the manufacturer tests correlate quantities of the fluid that the PCV allows to flow through the pipeline at respective open positions of the PCV;

after installing the PCV in a flowline downstream of a production tree disposed within a hydrocarbon gas production wellbore to control hydrocarbon gas flowrate through the production wellbore, performing operational tests on the PCV to measure quantities of the hydrocarbon gas that the PCV allows to flow through the flowline at the respective open positions of the PCV, wherein performing operational tests on the PCV comprises:

(a) setting the PCV to an open position;

(b) measuring a flowing wellhead pressure (FWHP) of the production wellbore at the open position of the PCV;

(c) measuring a hydrocarbon gas flowrate through the flowline at the open position of the PCV;

(d) measuring a condensate rate through the flowline at the open position of the PCV;

(e) determining a condensate to gas ratio (CGR) by dividing the condensate rate by the hydrocarbon gas flowrate; and (f) determining a choke size at the open position of the PCV based on the FWHP, the hydrocarbon gas flowrate and the CGR at the open position of the PCV;

comparing the results of the manufacturer tests with results of the operational tests; and based on a result of the comparing, determining an operational condition of the PCV.

2. The method of claim 1, further comprising:

repeating steps (a), (b), (c), (d) and (e) at each of the open positions; and generating a plot of a plurality of choke sizes versus the respective open positions of the PCV.

3. The method of claim 2, wherein results of the manufacturer tests comprise a manufacturer plot of a plurality of choke sizes versus the respective open positions of the PCV, wherein comparing the results of the manufacturer tests with results of the operational tests comprises:

determining a difference between an area under the manufacturer plot and an area under the plot; and comparing the difference with a threshold area.

4. The method of claim 3, wherein based on a result of the comparing, determining an operational condition of the PCV comprises:

determining that the difference exceeds the threshold area; and in response to determining that the threshold exceeds the threshold area, determining that the operational condition of the PCV is faulty.

5. The method of claim 4, further comprising, in response to determining that the operational condition of the PCV is faulty, transmitting an alert to rectify the PCV.

6. The method of claim 4, further comprising, in response to determining that the operational condition of the PCV is faulty:

ceasing the hydrocarbon gas production through the production wellbore;

replacing the PCV with a new PCV; and re-starting the hydrocarbon gas production through the production wellbore.

7. The method of claim 1, wherein determining the choke size at the open position of the PCV based on the FWHP, the hydrocarbon gas flowrate and the CGR at the open position of the PCV comprises solving equation:

$$\left(\frac{d}{64}\right) = \sqrt[1.85146181546]{\frac{qg \cdot 59.8929355006557 \cdot CGR^{0.1031801407188}}{FWHP}}$$

wherein d is the choke size, and qg is the hydrocarbon gas flowrate.

8. A computer-implemented method comprising:

for a pressure control valve (PCV) configured to control flowrate of a fluid through a pipeline, receiving a manufacturer plot of a plurality of choke sizes versus respective open positions of the PCV, wherein the manufacturer plot correlates quantities of the fluid that the PCV allows to flow through the pipeline at the respective open positions of the PCV;

after installing the PCV in a flowline downstream of a production tree disposed within a hydrocarbon gas production wellbore to control hydrocarbon gas flowrate through the production wellbore, receiving a plot of a plurality of choke sizes versus the respective open positions of the PCV, wherein the plot is generated responsive to performing operational tests to measure quantities of the hydrocarbon gas that the PCV allows to flow through the flowline at the respective open positions of the PCV, wherein the operational tests on the PCV comprise:

(a) setting the PCV to an open position, (b) measuring a flowing wellhead pressure (FWHP) of the production wellbore at the open position of the PCV, (c) measuring a hydrocarbon gas flowrate through the flowline at the open position of the PCV, (d) measuring a condensate rate through the flowline at the open position of the PCV, (e) receiving the open position of the PCV, the FWHP, the hydrocarbon gas flowrate and the condensate rate;

(f) determining a condensate to gas ratio (CGR) by dividing the condensate rate by the hydrocarbon gas flowrate; and (g) determining a choke size at the open position of the PCV based on the FWHP, the hydrocarbon gas flowrate and the CGR at the open position of the PCV;

comparing the manufacturer plot with the plot;

based on a result of the comparing, determining that an operational condition of the PCV is faulty; and in response to determining that the operational condition of the PCV is faulty, transmitting an alert indicating the faulty operational condition of the PCV.

9. The method of claim 8, wherein the operational tests comprise repeating steps (a), (b), (c) and (d), wherein the method further comprises:

repeating steps (e), (f) and (g); and generating the plot of the plurality of choke sizes versus the respective open positions of the PCV.

10. The method of claim 8, wherein determining the choke size at the open position of the PCV based on the FWHP, the hydrocarbon gas flowrate and the CGR at the open position of the PCV comprises solving equation:

$$\left(\frac{d}{64}\right) = \sqrt[1.85146181546]{\frac{qg \cdot 59.8929355006557 \cdot CGR^{0.1031801407188}}{FWHP}}$$

wherein d is the choke size, and qg is the hydrocarbon gas flowrate.

11. The method of claim 8, wherein comparing the manufacturer plot with the plot comprises:

determining a difference between an area under the manufacturer plot and an area under the plot; and comparing the difference with a threshold area.

12. The method of claim 11, wherein based on a result of the comparing, determining that an operational condition of the PCV is faulty comprises determining that the difference exceeds the threshold area.

13. A non-transitory computer-readable medium storing instructions executable by one or more computer systems to perform operations comprising:

for a pressure control valve (PCV) configured to control flowrate of a fluid through a pipeline, receiving a manufacturer plot of a plurality of choke sizes versus respective open positions of the PCV, wherein the manufacturer plot correlates quantities of the fluid that the PCV allows to flow through the pipeline at the respective open positions of the PCV;

after installing the PCV in a flowline downstream of a production tree disposed within a hydrocarbon gas production wellbore to control hydrocarbon gas flowrate through the production wellbore, receiving a plot of a plurality of choke sizes versus the respective open positions of the PCV, wherein the plot is generated responsive to performing operational tests to measure quantities of the hydrocarbon gas that the PCV allows to flow through the flowline at the respective open positions of the PCV, wherein the operational tests on the PCV comprise:

(a) setting the PCV to an open position, (b) measuring a flowing wellhead pressure (FWHP) of the production wellbore at the open position of the PCV, (c) measuring a hydrocarbon gas flowrate through the flowline at the open position of the PCV, (d) measuring a condensate rate through the flowline at the open position of the PCV, (e) receiving the open position of the PCV, the FWHP, the hydrocarbon gas flowrate and the condensate rate;

(f) determining a condensate to gas ratio (CGR) by dividing the condensate rate by the hydrocarbon gas flowrate; and (g) determining a choke size at the open position of the PCV based on the FWHP, the hydrocarbon gas flowrate and the CGR at the open position of the PCV;

comparing the manufacturer plot with the plot;

based on a result of the comparing, determining that an operational condition of the PCV is faulty; and in response to determining that the operational condition of the PCV is faulty, transmitting an alert indicating the faulty operational condition of the PCV.

14. The medium of claim 13, wherein the operational tests comprise repeating steps (a), (b), (c) and (d), wherein the operations further comprise:

repeating steps (e), (f) and (g); and generating the plot of the plurality of choke sizes versus the respective open positions of the PCV.

15. The medium of claim 13, wherein determining the choke size at the open position of the PCV based on the FWHP, the hydrocarbon gas flowrate and the CGR at the open position of the PCV comprises solving equation:

$$\left(\frac{d}{64}\right) = \sqrt[1.85146181546]{\frac{qg \cdot 59.8929355006557 \cdot CGR^{0.1031801407188}}{FWHP}}$$

wherein d is the choke size, and qg is the hydrocarbon gas flowrate.

16. The medium of claim 13, wherein comparing the manufacturer plot with the plot comprises:

determining a difference between an area under the manufacturer plot and an area under the plot; and comparing the difference with a threshold area.

17. The medium of claim 16, wherein based on a result of the comparing, determining that an operational condition of the PCV is faulty comprises determining that the difference exceeds the threshold area.

* * * * *